US006171142B1

(12) United States Patent
Wang et al.

(10) Patent No.: US 6,171,142 B1
(45) Date of Patent: Jan. 9, 2001

(54) ELECTRICAL CONNECTOR ASSEMBLY

(75) Inventors: Zhi-Qiang Wang; Zi-Qiang Zhu; Liang Gong, all of Kun-San (CH)

(73) Assignee: Hon Hai Precision Ind. Co., Ltd., Taipei Hsien (TW)

( * ) Notice: Under 35 U.S.C. 154(b), the term of this patent shall be extended for 0 days.

(21) Appl. No.: 09/421,443

(22) Filed: Oct. 19, 1999

(30) Foreign Application Priority Data

Jul. 2, 1999 (TW) ..... 88211063

(51) Int. Cl.[7] ..... H01R 13/73
(52) U.S. Cl. ..... 439/567; 439/79
(58) Field of Search ..... 439/567, 79, 541.5, 439/571, 572

(56) References Cited

U.S. PATENT DOCUMENTS 4,878,856 * 11/1989 Maxwell ..... 439/540.1
5,085,590 * 2/1992 Galloway ..... 439/95
5,643,008 * 7/1997 Tan et al. ..... 439/541.5
5,800,207 * 9/1998 Hsu et al. ..... 439/541.5
5,961,346 * 10/1999 Choy ..... 439/567

* cited by examiner

*Primary Examiner*—Gary F. Paumen
(74) *Attorney, Agent, or Firm*—Wei Te Chung

(57) ABSTRACT

A connector assembly comprises a connector member, a bracket and a pair of board locks. The connector member includes an insulative housing having a front face and a rear face. The bracket is unitarily molded to include a spacer and a standing wall perpendicular to the spacer. A pair of strengthening walls is disposed perpendicularly extend from opposite edges of the spacer. The strengthening walls also perpendicularly extend from the same side of the standing wall. A pair of supporting plates for supporting the rear face of the connector member upwardly extends from an edge of the standing wall proximate opposite ends thereof. An angle between the supporting plates and the spacer is substantially 45°.

2 Claims, 6 Drawing Sheets

ELECTRICAL CONNECTOR ASSEMBLY

BACKGROUND OF THE INVENTION

The present invention relates to an electrical connector assembly, and especially to an electrical connector assembly adapted to mate with a mating connector in a direction oblique to a PCB (Printed Circuit Board) on which the electrical connector assembly is mounted.

A D-SUB (subminiature) connector is commonly used in a computer to provide an I/O port between a PCB and a peripheral device such as a monitor, a mouse, a printer, a digital camera or a game controller. To efficiently use space on a PCB, two or more D-SUB connectors are stacked mounted to the PCB.

A stacked connector assembly is disclosed in U.S. Pat. Nos. 4,878,856 and 5,085,590. The assembly has a mating surface parallel to a panel. The panel defines an opening to access the connector for allowing insertion of a mating connector. The assembly has a mounting surface perpendicular to the mating surface and parallel to a PCB. The mounting surface of the assembly is mounted to the PCB. However, the assembly of two or three D-SUB connectors has a significant height relative to a length of the mounting surface along the insertion direction of the mating connector. Thus, an insertion force exerted on a top of the assembly and perpendicular to the mating surface exerts a momental force relative to the mating surface: Such a momental force may adversely affect connection reliability between the assembly and the PCB, or the assembly may even become detached from the PCB.

In addition, the conventional D-SUB connector assembly is only used in a situation where the panel is perpendicular to the PCB. However, in some special situation, the panel is required to be oblique to the PCB. Therefore, a D-SUB connector assembly which can be used in such a special situation is desired.

SUMMARY OF THE INVENTION

Accordingly, the primary object of the present invention is to provide a connector assembly for engaging with a mating connector inserted from a direction oblique to a PCB on which the connector assembly is mounted.

Another object of the present invention is to provide a connector assembly which can be reliably retained on a PCB.

To fulfill the above-mentioned objects, a connector assembly in accordance with the present invention comprises a connector member, a bracket and a pair of board locks. The connector member includes an insulative housing. The housing has a front face and a rear face opposite the rear face with a pair of openings defined proximate opposite ends thereof. The bracket is unitarily molded to include a spacer and a standing wall perpendicular to the spacer. A pair of strengthening walls perpendicularly extend from opposite edges of the spacer. The strengthening walls also perpendicularly extend from the same side of the standing wall. A pair of supporting piates upwardly extends from an edge of the standing wall proximate opposite ends thereof. Each supporting plate is oblique to the standing wall and retained by the strengthening wall. An aperture is defined through the supporting plate. The connector member is mounted to the bracket with the rear face attached to the supporting plates and the openings aligned with the apertures. Therefore, the connector member is oblique to the standing wall and the spacer. When the assembly is mounted to the PCB, the connector member is oblique to the PCB.

According to another aspect of the present invention, a pair of elongate board locks is mounted to the bracket for securing the bracket to the PCB. Each board lock includes a body, a tab extending from an upper edge of the body and a pair of legs extending from a lower edge of the body. The tab is oblique to the body and defines a hole therethrough. A hook extends from the body between the legs. In assembly, the tab is attached to the supporting plate with the hole aligned with the aperture. The hook is adapted to engage with a recess formed in the bracket. A rivet is inserted through the hole of the board lock, the aperture of the bracket and the opening of the connector member and secures the three parts together by riveting.

Other objects, advantages and novel features of the invention will become more apparent from the following detailed description when taken in conjunction with the accompanying drawings.

DETAILED DESCRIPTION OF A PREFERRED EMBODIMENT

Figure 1:
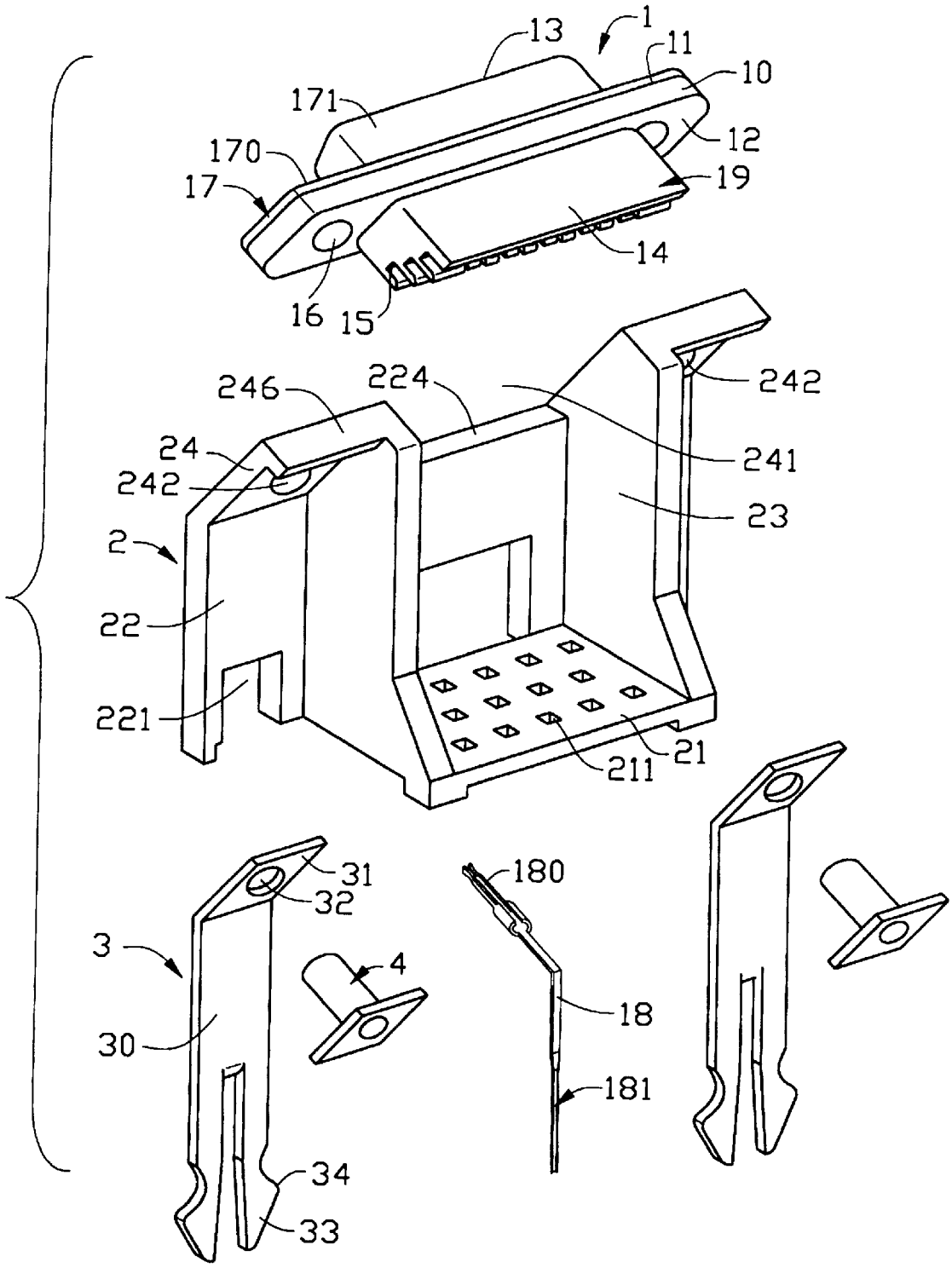
FIG. 1 is an exploded view of a connector assembly in accordance with the present invention.

Referring to FIG. 1, a connector assembly in accordance with the present invention comprises a D-SUB connector member 1, a bracket 2 and a pair of board locks 3. The connector member 1 includes an insulative housing 19, a plurality of terminals 18 retained in the housing 19 and a shield 17. The housing 19 includes an elongate mounting plate 10 having a front face 11 and a rear face 12. A front protrusion 13 extends from the front face 11 and a rear protrusion 14 extends from the rear face 12. The front and rear protrusions 13, 14 are perpendicular to the mounting plate 10. A plurality of passageways 15 is defined through the front protrusion 13 and the rear protrusion 14. A pair of openings 16 is defined in the mounting plate 10 proximate opposite ends thereof. Each terminal 18 includes a mating end 180 and a mounting tail 181. An angle between the mating end 180 and the mounting tail 181 is substantially 135°. The mating portions 180 of the terminals 18 are inserted into the corresponding passageways 15 of housing 19. The shield 17 includes a plate section 170 attached to the front face 11 of the mounting plate 10 and a shroud 171 surrounding the front protrusion 13. The shield 17 defines a pair of openings (not shown) aligned with the openings 16 of the mounting plate 10.

The bracket 2 is unitarily molded to include a spacer 21 and a standing wall 22 perpendicular to the spacer 21. The spacer 21 defines a plurality of mounting apertures 211 therethrough for securing the mounting tails 181 of the terminals 18 therein. A pair of strengthening walls 23 perpendicularly extend from opposite edges of the spacer. The strengthening walls 23 also perpendicularly extend from the same side of the standing wall 22. A passage 241 is defined between an upper edge 224 of the standing wall 22 and the strengthening walls 23. A pair of supporting plates 24 upwardly extends from the upper edge 224 of the standing wall 22 proximate opposite lateral ends thereof. The supporting plates 24 are separated by the passage 241.

Each supporting plate 24 is oblique to the standing wall 22 and an angle between the supporting plate 21 and the standing wall 22 is substantially 135°. The supporting plate 24 perpendicularly extends from the strengthening wall 23. An aperture 242 is defined through each supporting plate 24.

Figure 3:
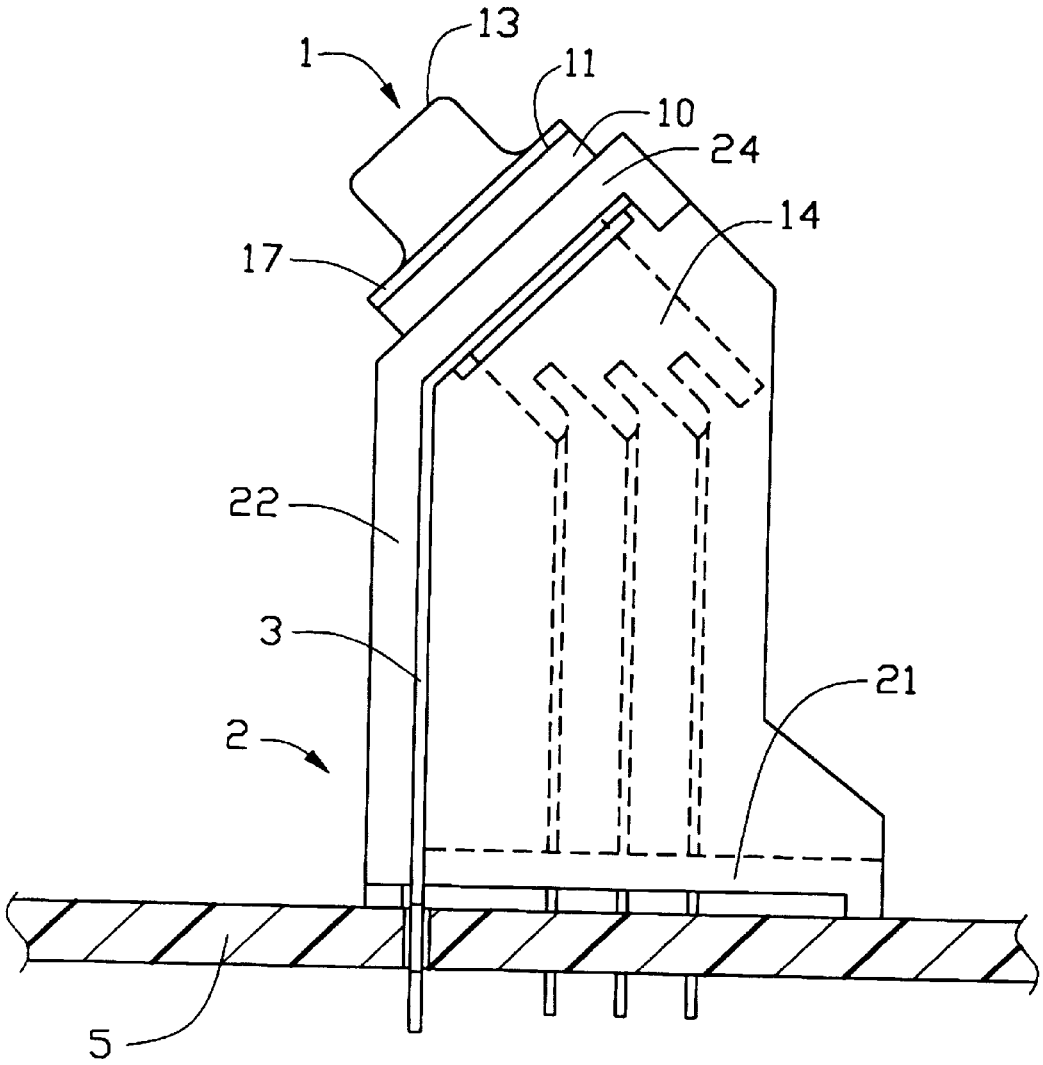
FIG. 3 is side assembled view of FIG. 1 and a PCB.

Also referring to FIG. 3, the connector member 1 is mounted to the bracket 2. The rear face 12 of the mounting plate 10 is attached to the supporting plates 24 with the apertures 242 aligned with the openings 16. The rear protrusion 14 extends into the passage 241 and is snugly retained therein. It should be noted that an angle between the mounting plate 24 and a PCB 5 is substantially 45° and an angle between the front or rear protrusions 13, 14 and the PCB 5 is also substantially 45°. The mounting tails 181 of the terminals 18 are soldered to the PCB 5 by through hole technology.

Figure 2:
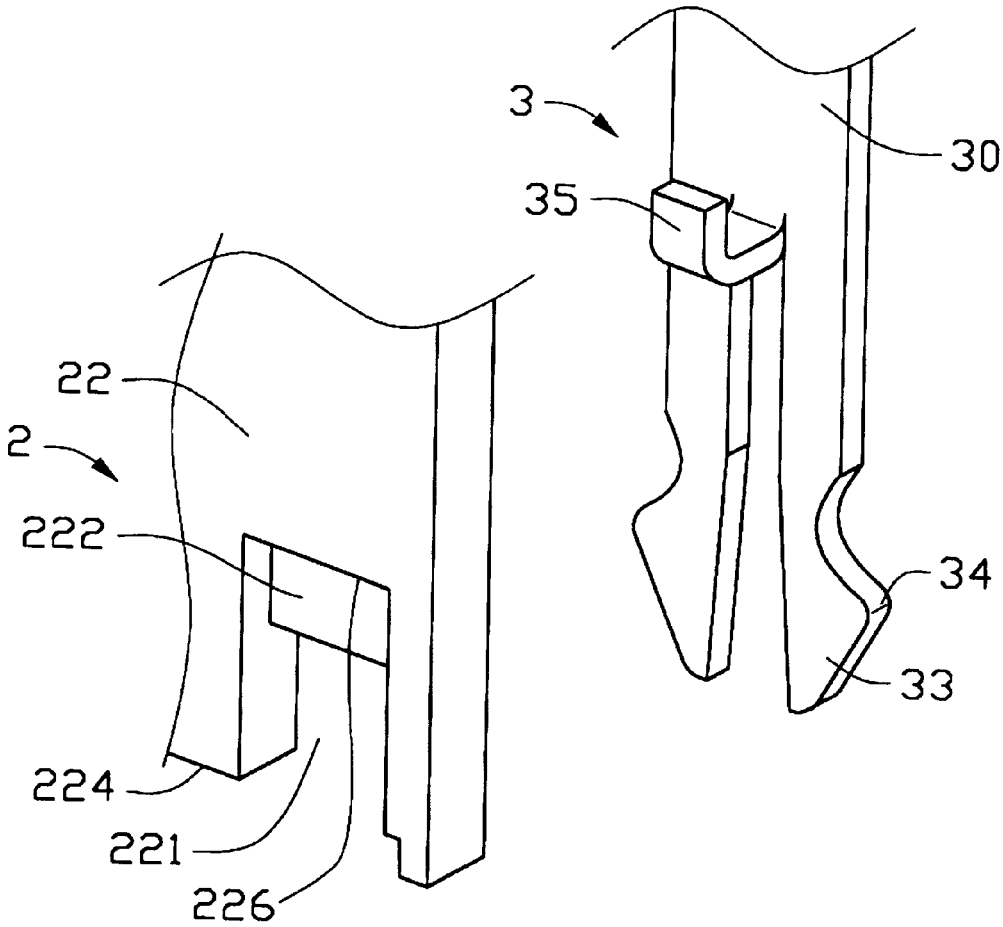
FIG. 2 is a partially enlarged view of a board lock and a bracket of the present invention.

Also referring to FIG. 2, each board lock 3 includes a main portion 30, a tab 31 upwardly extending from the main portion 30 and a pair of spaced legs 33 downwardly extending from the main portion 30. An angle between the tab 31 and the main portion 30 is substantially 135°. A hole 32 is defined through the tab 31. Each leg 33 forms a projection 34 for engaging a bottom surface of the PCB 5. A hook 35 outwardly extends from the main portion 30 between the legs 33. Each standing wall 22 defines a cutout 221 exposed to a lower edge 224 thereof. A rib 222 is formed proximate a top end 226 of the cutout 221. A stop portion 246 perpendicularly extends downward from an upper edge of each supporting plate 24. In assembly, the tab 31 of the board lock 3 is attached to the supporting plate 24 with the hole 32 aligned with the aperture 242 and a leading edge of the board lock 3 is stopped by the stop portion 246 for fixing purposes. The hook 35 engages the rib 242 of the standing wall 22 thereby securing the board lock 3 to the bracket 2. A rivet 4 is inserted through the hole 32 of the board lock 3, the aperture 242 of the bracket 2 and the opening 16 of the connector member 1, and secures the three parts together by riveting.

Figure 4:
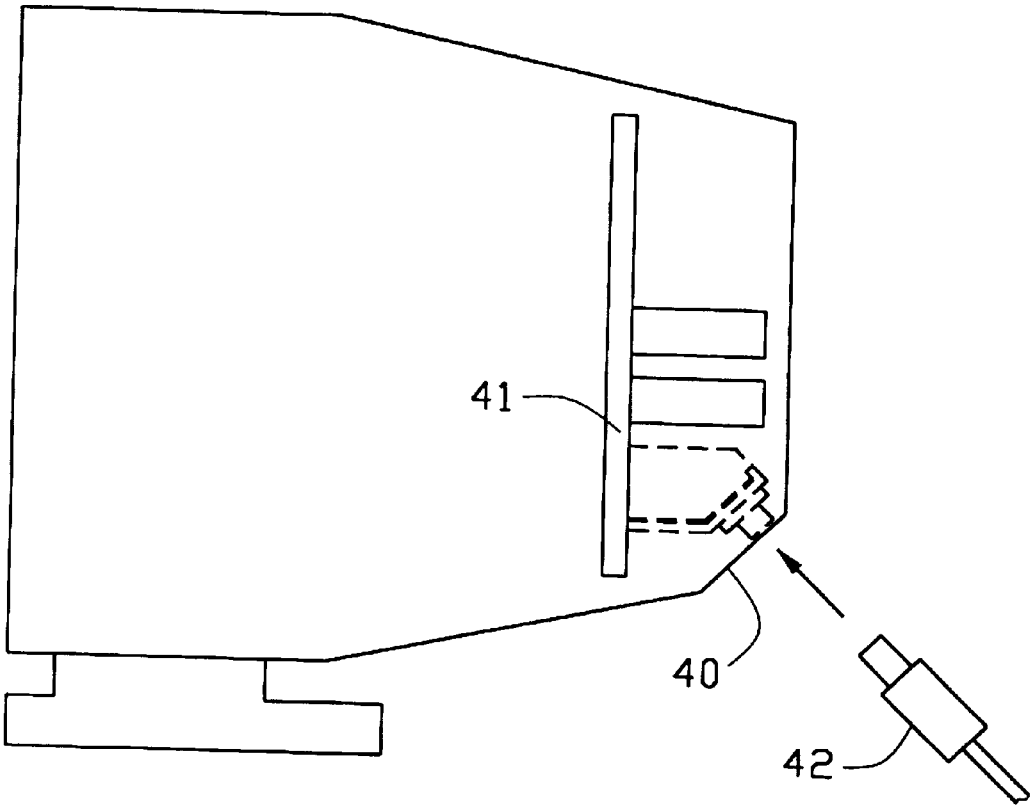
FIG. 4 is a side view of the connector assembly of the present invention mounted in an electrical device.
Figure 5:
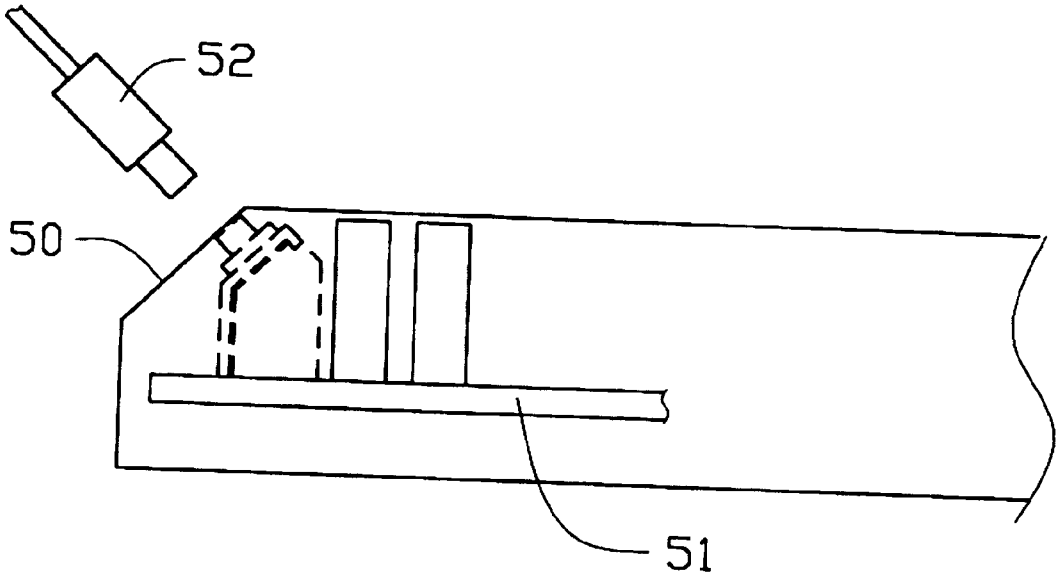
FIG. 5 is a side view of the connector assembly of the present invention in another electrical device.

Referring to FIGS. 4 and 5, the connector assembly is used in a situation wherein a panel 40 (50) which defines an opening (not shown) to expose the connector member 1 is oblique to a PCB 41 (51) on which the connector assembly is mounted. For example, an angle between the panel 40 (50) and the PCB 41 (51) is substantially 45°. A mating connector 42 (52) is adapted to mate with the connector assembly in a direction which forms an angle of substantially 45° with the PCB 41 (51). However, it is understood that the angle between the panel 40 (50) and the PCB 41 (51) can be of any value between 0 through 90 degrees according to the requirement of an actual situation as long as the structure of the connector assembly is accordingly adjusted.

In addition, the insertion force which the mating connector 42 (52) exerts on the connector assembly can be separated into a vertical force and a horizontal force. The vertical force is resisted by the board locks 3 mounted on the PCB 41 (51). The horizontal force exerted on a top of the connector assembly forms a momental force relative to a junction between the connector assembly and the PCB 41 (51). Such a momental force may adversely affect connection reliability between the connector assembly and the PCB 41 (51). However, since the horizontal force is much less than the original insertion force, the momental force is significantly decreased. Thus, the connector assembly can be reliably mounted on the PCB 41 (51).

Figure 6:
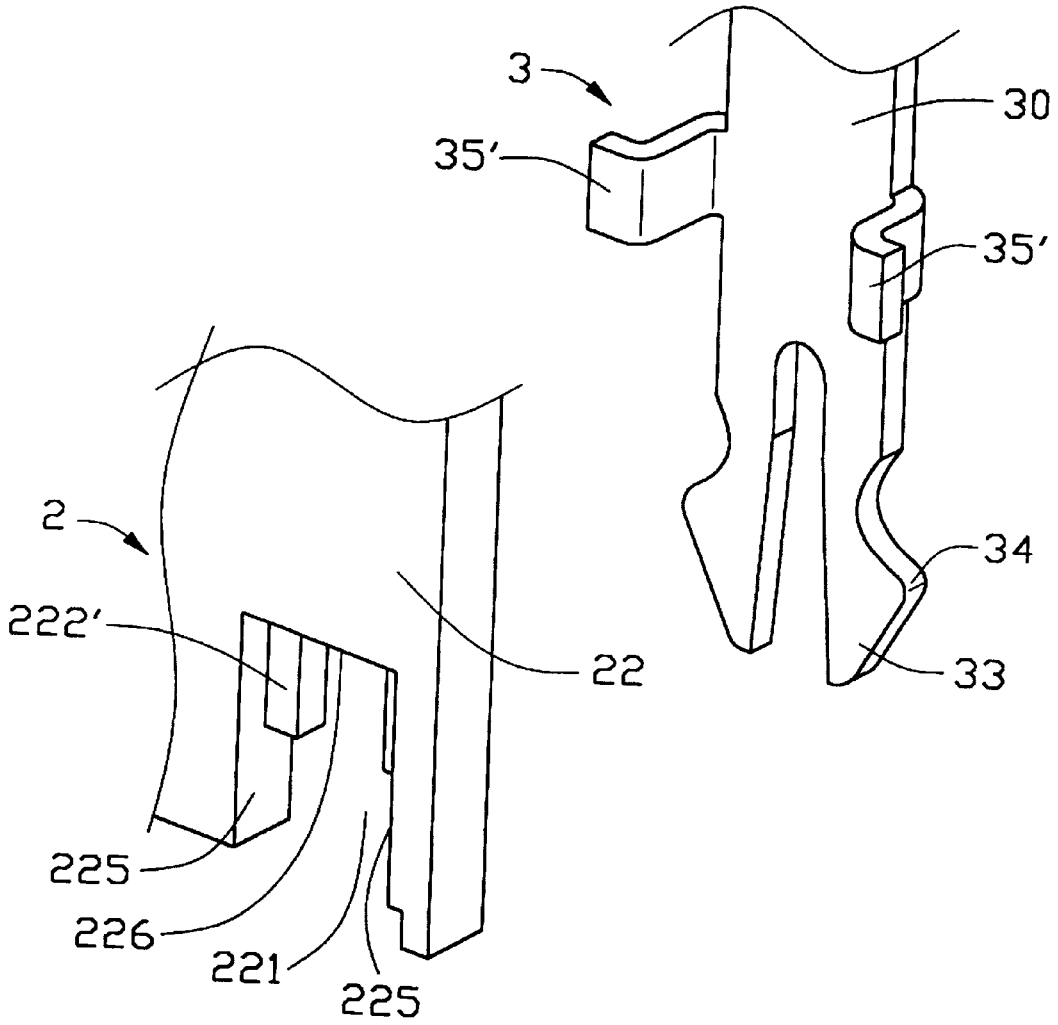
FIG. 6 a partially enlarged view of a board lock and a bracket of an alternative embodiment of the present invention.

FIG. 6 shows a board lock 3 and a bracket 2 of an alternative embodiment of the present invention. The differences between the two embodiments reside in the method of securing the board lock 3 to the bracket 2. Therefore, the reference numerals applied in FIG. 2 are used to designate like components of the connector assembly of the alternative embodiment.

The board lock 3 includes a pair of hooks 35' extending from opposite lateral edges of the main portion 30. A pair of ribs 222' inwardly extends from opposite lateral edges 225 of the cutout 221 proximate the upper edge 226 thereof. In assembly, the hooks 35' snappingly engage the ribs 222' thereby securing the board lock 3 to the bracket 2.

Even though in this embodiment the bracket 2 is made separated from the connector member 1, it is appreciated that the bracket 2 may be integrally formed with the housing if the spacer 21 is not integrally formed thereof and is adapted to be detachably attached thereto. It is also noted that different from the prior art contacts, in the invention, the terminals 18 of the three different rows have the mounting tails 181 with the same length exposed outside the housing 19 while respectively owning different length portions (not labeled) retained in the housing 19. The conventional vertical type or right angle type connectors lack this feature.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly mounted on a PCB, comprising:

a connector member including an insulative housing having a mounting plate, and a plurality of terminals retained in the housing;

a bracket securely supporting the connector member and including a standing wall, a pair of supporting plates extending from an upper edge of the standing wall for supportingly engaging the mounting plate, a spacer substantially perpendicularly extending from the standing wall to fix the terminals;

a pair of board locks for fixing the bracket on the PCB; and a pair of rivets securing the board locks, the bracket and the connector member together;

wherein the standing wall is located perpendicular to the PCB and the supporting plate is located inclined to the standing wall;

wherein the bracket is unitarily formed;

wherein the bracket includes a pair of strengthening walls perpendicularly extending from the spacer and supporting the mounting plate;

wherein each board lock includes a main portion, a tab upwardly extending from the main portion, a pair of spaced legs, and a hook outwardly extending from the main portion between the legs, and wherein the bracket defines a cutout and forms a rib proximate an upper edge of the cutout, the hook engaging the rib thereby securing the board lock to the bracket;

wherein the mounting plate of the connector member defines an opening, the supporting plate of the bracket defines an aperture aligned with the opening, and the tab of the board lock defines a hole aligned with the aperture, the rivet extending through the hole, the aperture and the opening and securing the board lock, the bracket and the connector member together by riveting.

2. The electrical connector assembly as claimed in claim 1, wherein the angle between the supporting plate and the spacer is substantially 45°.

* * * * *